US005103570A

United States Patent [19]

Nichols

[11] Patent Number: 5,103,570

[45] Date of Patent: Apr. 14, 1992

[54] SQUARE RELIEF DEVICE

[76] Inventor: Charles W. Nichols, 154 Topsfield Rd., Boxford, Mass.

[21] Appl. No.: 648,012

[22] Filed: Jan. 30, 1991

[51] Int. Cl.[5] ..... B43L 7/02

[52] U.S. Cl. ..... 33/479; 33/481; 33/480; 33/429

[58] Field of Search ..... 33/429, 428, 474, 476, 33/479, 480, 481, 42, 468, 469, 470

[56] References Cited

U.S. PATENT DOCUMENTS

| | | | |
|---|---|---|---|
| 635,050 | 10/1899 | MacFarren | 33/480 |
| 771,392 | 10/1904 | Rechenberg | 33/418 |
| 2,435,799 | 2/1948 | Rizor | 33/474 |

FOREIGN PATENT DOCUMENTS

| | | | |
|---|---|---|---|
| 168498 | 6/1951 | Austria | 33/468 |
| 1211402 | 10/1959 | France | 33/480 |

*Primary Examiner*—Harry N. Haroian

*Attorney, Agent, or Firm*—Edward A. Gordon

[57] ABSTRACT

A square device for use by steel fabricators including a blade member and a beam member attached adjacent one end of the blade member whereby the adjacent inner surfaces of the blade member and beam member are at right angles to each other, and an elongated notch defined by the inner surface of the beam member extending from one end of the inner surface of the beam member to the other end of the beam member and which is of sufficient width whereby a portion of the notch extends above and below the blade member. In a preferred embodiment, the inner corner of the beam member is provided with a vertical groove.

1 Claim, 2 Drawing Sheets

FIG. 3A
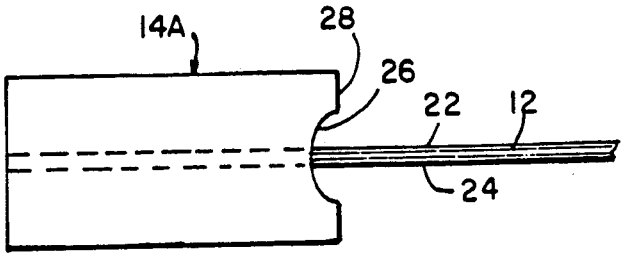
FIG. 3B
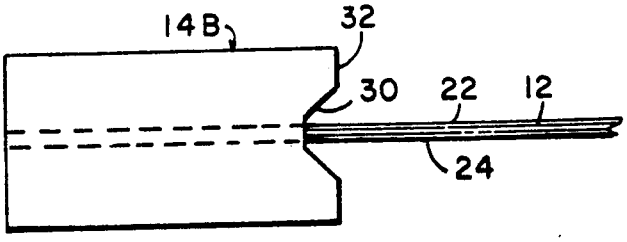
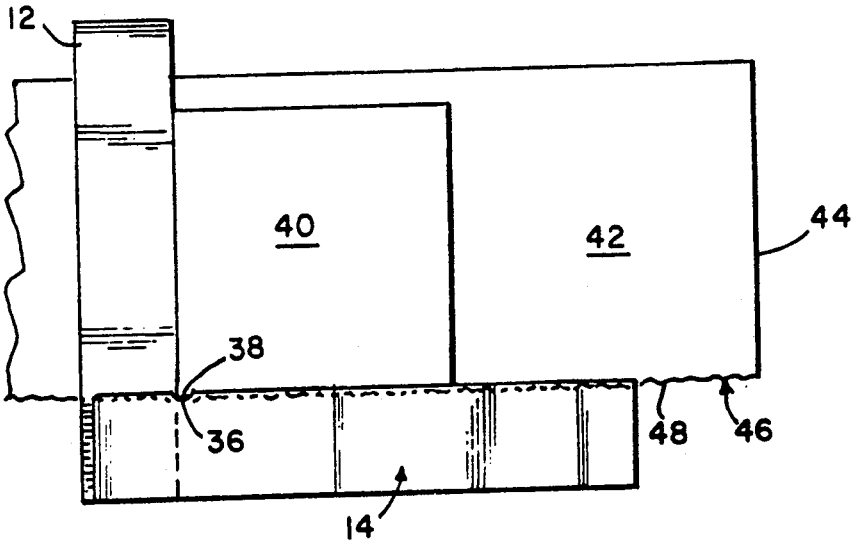
FIG. 6

SQUARE RELIEF DEVICE

BACKGROUND OF THE INVENTION

1. Field Of The Invention

The present invention relates generally to square devices for use particularly but not exclusively with fabricating machines such as milling and grinding machines, and more particularly to an improved square which overcomes the defects, such as burrs and nicks, on the critical edges of work area surfaces of fabricating machines.

2. Description Of Prior Art

The conventional prior art squares which have been used for many years consist of a blade member and a beam member attached to one end of the blade member so that both the inside and outside surfaces of the beam and blade members form right angles. Additionally, in some of the prior art square devices, the inner corner of the beam member is grooved to provide for clearance of burr and dirt which may be present on the workpieces. The state of the art is believed to be indicated by the following U.S. Pat. Nos.:

| | |
|---|---|
| 635,050 | 919,883 |
| 715,550 | 3,499,225 |

While such prior art devices provide improvements in the areas intended, there still exists a great need for a simplified structure which overcomes the long existing problems of not providing accuracy for straightness and parallelism for the workpiece when the square is brought into contact with the workpiece and particularly the edge of the work surface of the various machines upon which the workpiece is to be treated.

Accordingly, a principle desirable object of the present invention is to provide a square device which overcomes the disadvantages of the prior art.

A still further desirable object of the present invention is to achieve the above desirable object by providing a square device with an essentially simple structure lending itself to inexpensive mass production.

These and other desirable objects of the present invention will in part appear hereinafter and will in part become apparent after consideration of the specification with reference to the drawings and the claims.

SUMMARY OF THE INVENTION

The present invention discloses an improved square for use by steel fabricators, for example, where extreme accuracy is required. In the preferred embodiment, the square is made of high quality hardened steel. In accordance with the present invention, the square device comprises a blade member and a beam member attached adjacent one end of the blade member whereby the adjacent inner surfaces of the blade member and beam member are at right angles to each other. An elongated notch defined by the inner surface of the beam member extends from one end of the inner surface of the beam member to the other end of the beam member and is of sufficient width whereby a portion of the notch extends above and below the blade member. The configuration of the notch can be concave, v-shaped, square or rectangular. The notch serves to provide for clearance or relief of burrs, nicks, dirt and other abnormalities which may exist along the corner edge of the workpiece support surface against which the square is brought in contact when aligning the workpiece for treatment. The notch provides accurate straight and parallel alignment of the workpiece upon the work surface. In a preferred embodiment, the inner corner of the beam member is provided with a vertical groove to provide for clearance of burrs and dirt which may be present on the related edge or corner of the workpiece.

BRIEF DESCRIPTION OF THE DRAWINGS

For a fuller understanding of the nature and desired objects of the present invention, reference should be made to the following detailed description taken in conjunction with the accompanying drawings wherein like reference characters denote corresponding parts throughout several views and wherein:

FIGS. 3A and 3B are enlarged fragmentary side elevational views illustrating alternate configurations of the notch defined by the inner surface of the beam member;

FIG. 6 is a top sectional view of the operating position of FIG. 4.

DETAILED DESCRIPTION OF PREFERRED EMBODIMENTS

Figure 1:
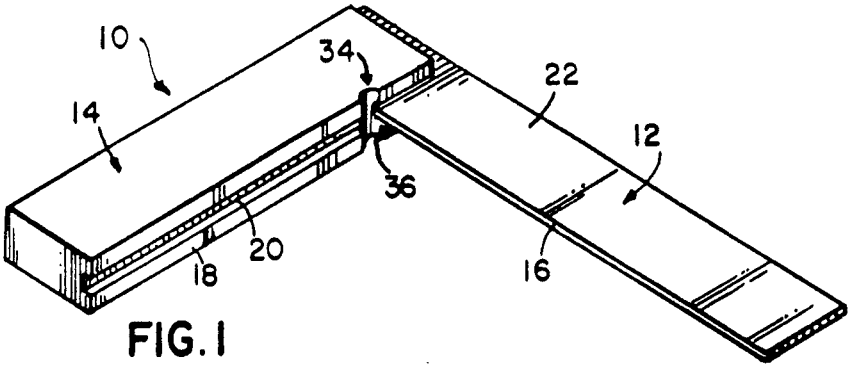
FIG. 1 is a perspective view of a square embodying the principles of the present invention.
Figure 2:
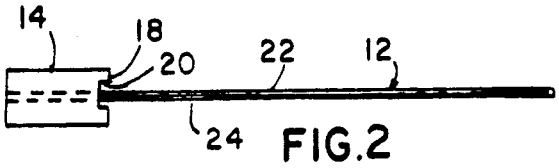
FIG. 2 is a side elevation view of the square of FIG. 1.

Referring now to the drawings and more particularly to FIGS. 1–3, there is illustrated a square device, indicated generally by the numeral 10, embodying the principles of the present invention. The square device 10 comprises an elongated blade member 12 and a beam member 14 attached adjacent one end of the blade member 12 so that the blade member 12 and beam member 14 form a right angle between each other. As shown, the inner surface 16 of the blade member 12 and the inner surface 18 of the beam member 14 are at right angles to each other. An elongated notch 20 is provided along the length of the inner side 18 of the beam member 14. As defined by the inner side 18, the notch 20 extends the full length of the beam member 14 and over and about the upper and lower sides 22 and 24 of the blade member 12 as best seen in FIG. 2 and FIGS. 3A and 3B discussed hereinafter. The configuration of the notch 20 is preferably rectangular-like as illustrated in FIGS. 1 and 2. As shown in FIG. 3A the notch 26 as defined by the inner side 28 of beam member 14A is provided with a u-shaped or concave configuration. In FIG. 3B, the notch 30 as defined by the inner side 32 of the beam member 14B is provided with a v-shaped concave configuration.

Referring now more particularly to FIG. 1, the inner corner section 34 of the beam member 14 is preferably provided with a vertical groove 36 defined by the inner surface 18 of the inner corner section 34 of the beam member 14. The groove 36 provides for clearance of burrs and dirt which may be present on the corner edges of the workpieces, such as, for example, the edge 38 of the workpiece 40 as best seen in FIGS. 4 and 6.

Figure 4:
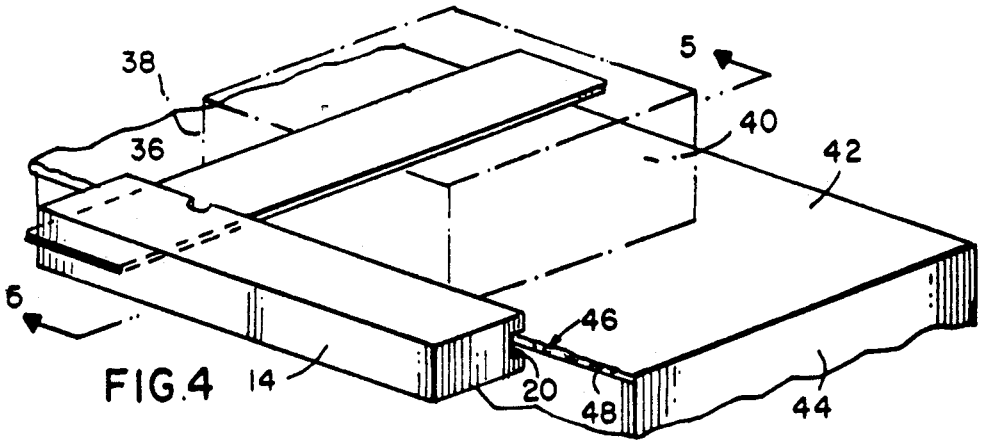
FIG. 4 is a fragmentary perspective view of the square of FIG. 1 in an operating position with a workpiece on the work surface of a fabricating machine.
Figure 5:
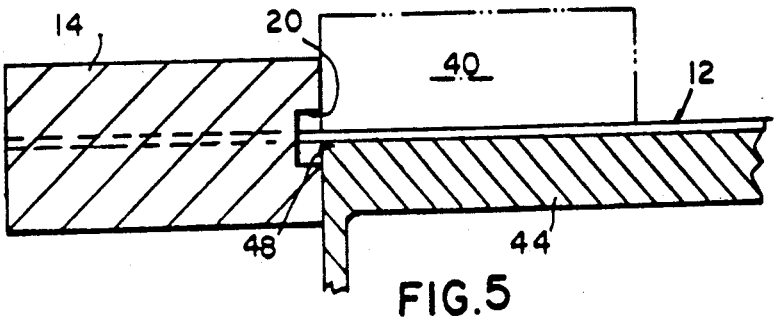
FIG. 5 is a cross sectional view taken along the line 5—5 of FIG. 4.

Referring now more particularly to FIGS. 4–6, there is illustrated one form of application of a square embodying the principles of the present invention. As shown, the workpiece 40 is positioned upon the work surface 42 of member 44 which is a portion of a fabricating machine such as a conventional grinding or milling machine (not shown). Also as shown, the edge 46 of the workpiece surface 42 has burrs 48.

As best seen in FIGS. 4 and 5, the notch 20 of the beam member 14 provides a relief space for the burrs 48. In this manner, the burrs 48 do not prevent the square member 10 from aligning the workpiece 40 with accurate straightness and parallelism which is essential prior to and during the fabrication of the workpiece carried on by the machine.

It is believed to be readily apparent from the foregoing description that the square relief device of the present invention obviates the problems incurred with prior art squares when used with fabricating apparatus having, for example, such defects as nicks, burrs, raised spots or dirt along the edge of the workpiece surface against which the square is brought in contact to provide straightness and parallelism for the workpiece.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

What is claimed is:

1. A unitary metal square relief device for steel fabrication comprising:

a blade member comprising an elongated flat plate member having upper and lower surfaces and a pair of mutually parallel elongated inner and outer edges;

a beam member attached about a portion of one end of the blade member; said beam member having a pair of mutually parallel inner and outer elongated vertical flat edge surfaces and upper and lower surfaces whereby the inner elongated vertical flat edge surface of the beam member is at a right angle to the inner elongated edge of the blade member;

an elongated notch provided in the inner elongated vertical flat edge surface of the beam member;

said notch extending form one end of said inner vertical surface of the beam member to the other end of the beam member and being of sufficient width whereby the notch extends over a portion of the upper and lower surfaces of the blade member; and a groove provided in the inner vertical flat edge surface of the beam member and extending from said beam upper surface to said beam lower surface and intersecting said notch so that said inner edge of said blade member extends into the intersection of the notch and groove, said groove being positioned adjacent the inner edge of the blade member and transverse thereto.

* * * * *